US009728870B2

(12) United States Patent
Kim

(10) Patent No.: US 9,728,870 B2
(45) Date of Patent: Aug. 8, 2017

(54) CARD CONNECTOR AND ELECTRONIC DEVICE INCLUDING THE SAME

(71) Applicant: Samsung Electronics Co., Ltd., Suwon-si, Gyeonggi-do (KR)

(72) Inventor: Yong-Yi Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/861,187

(22) Filed: Sep. 22, 2015

(65) Prior Publication Data

US 2016/0087358 A1 Mar. 24, 2016

(30) Foreign Application Priority Data

Sep. 22, 2014 (KR) ..... 10-2014-0125956

(51) Int. Cl.

| | |
|---|---|
| ***H01R 12/70*** | (2011.01) |
| ***H01R 12/71*** | (2011.01) |
| ***H01R 13/629*** | (2006.01) |
| *H01R 13/24* | (2006.01) |

(52) U.S. Cl.

CPC ..... *H01R 12/7076* (2013.01); *H01R 12/714* (2013.01); *H01R 13/629* (2013.01); *H01R 13/24* (2013.01); *H01R 2201/16* (2013.01)

(58) Field of Classification Search

CPC ..... H01R 12/7076; H01R 12/712; H01R 12/714; H01R 12/716; H01R 13/24; H01R 13/2414; H01R 23/722

USPC ..... 439/630, 68, 660, 155, 923, 65, 66, 70, 439/71, 74, 78, 80, 81, 82, 84

See application file for complete search history.

(56) References Cited

U.S. PATENT DOCUMENTS

| | | | | |
|---|---|---|---|---|
| 4,398,277 | A * | 8/1983 | Christiansen | A61N 1/14 361/212 |
| 5,754,389 | A * | 5/1998 | Hsu | A61N 1/14 361/212 |
| 6,175,505 | B1 * | 1/2001 | Cheng | H04B 1/3816 361/737 |
| 7,252,529 | B2 * | 8/2007 | Yang | H01R 13/639 439/327 |
| 7,329,146 | B2 * | 2/2008 | Yang | H01R 12/7029 439/570 |
| 7,442,044 | B2 * | 10/2008 | Yang | G06K 7/0021 439/328 |
| 7,503,805 | B2 * | 3/2009 | Chang | H01R 13/2442 200/51.1 |
| 7,568,952 | B2 * | 8/2009 | Long | H01R 12/716 439/630 |
| 7,708,597 | B2 * | 5/2010 | Hu | H01R 12/716 439/630 |
| 2004/0157491 | A1 * | 8/2004 | Lin | H01R 12/721 439/607.37 |

(Continued)

FOREIGN PATENT DOCUMENTS

KR 10-1369612 B1 3/2014

*Primary Examiner* — Harshad Patel

(74) *Attorney, Agent, or Firm* — Jefferson IP Law, LLP

(57) ABSTRACT

A slim card connector is provided. The slim card connector includes a board in which a plurality of openings are arranged at an interval and a plurality of contact terminals provided in the board to be received in the openings, wherein the contact terminals are received in the openings, respectively, when the contact terminals are in contact with a card.

7 Claims, 18 Drawing Sheets

(56) References Cited

U.S. PATENT DOCUMENTS

2005/0239333 A1* 10/2005 Watanabe ..... G06K 7/0021
439/630
2009/0111286 A1* 4/2009 Giovannoni ..... G06K 19/07762
439/37

* cited by examiner

CARD CONNECTOR AND ELECTRONIC DEVICE INCLUDING THE SAME

CROSS-REFERENCE TO RELATED APPLICATION(S)

This application claims the benefit under 35 U.S.C. §119 (a) of a Korean patent application filed on Sep. 22, 2014 in the Korean Intellectual Property Office and assigned Ser. No. 10-2014-0125956, the entire disclosure of which is hereby incorporated by reference.

TECHNICAL FIELD

The present disclosure relates to a technology for a card connector.

BACKGROUND

An electronic device that has a communication function is equipped with an identity module, and the identity module is a chip or a card in which various information for authenticating the authority of the user is stored and includes a user identity module (UIM), a subscriber identity module (SIM), and a universal SIM (USIM).

Furthermore, an electronic device is a storage medium for expanding the storage capacity, and may include a secure digital (SD) card in the form of a chip.

The listed identity module or SD card adopts an attachable connection structure in which a card is introduced into, and extracted from, a socket of the body thereof.

An example of a card attaching structure includes a structure in which an external cover is mounted in an opening (an entrance through which a card is inserted) of an electronic device, or a card is attached or detached by a tray in which a card is received, in a drawer form, or a structure in which a card in the form of a chip is attached or detached using a slim connector (a card connection holder or a card connection socket) that is manufactured separately.

As the electronic device becomes more light-weight, slim, short, and small-sized, additional functional devices are being actively miniaturized, and according to the situation, an act of directly applying external force to the surface of an additional device acts as a physical fracture factor of that additional device.

Accordingly, a structure is used to connect various signals of a SIM to an electronic device using a separate connector in which a SIM card, which is an essential element of the electronic device, is positioned.

As a slim SIM connector is implemented, SIM connectors in various forms are being used, but the SIM connectors have the following problems according to the forms thereof.

Because the contact terminal of a SIM card and the housing of a guide that prevents the movement of the SIM card are implemented by one connector, it is difficult to implement a slim design due to an increase of the thickness of the connector.

The connector that has a slim SIM connector may cause a malfunction or movement of a SIM card due to the deformation of a connector pin.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a subscriber identity module (SIM) connector that can implement a slim design by reducing the height of a periphery thereof.

Another aspect of the present disclosure is to provide a SIM connector that can implement SIM connectors of various standards, such as a nano SIM and a micro SIM, by only changing the shape of a guide.

Another aspect of the present disclosure is to provide a SIM connector that can increase the degree of freedom of design, regardless of the external design of an electronic device.

Another aspect of the present disclosure is to provide a SIM connector that can increase the manufacturing efficiency and user convenience by protecting a contact terminal as compared with a slim connector.

Another aspect of the present disclosure is to provide a SIM connector that can prevent the deformation of a contact pin, which may occur in a manufacturing processor or during the use thereof by consumers, by protecting the contact pin thereof while reducing the restriction of design of the electronic device by designing the SIM connector to be slim.

In accordance with an aspect of the present disclosure, a card connector is provided. The card connector includes a board in which a plurality of openings are arranged at an interval and a plurality of contact terminals provided in the board to be received in the openings, wherein the contact terminals are received in the openings, respectively, when the contact terminals are in contact with a card.

In accordance with another aspect of the present disclosure, an electronic device is provided. The electronic device includes a case, a board located within the case, a card connector arranged in the board and arranged to be spaced apart from the case by a predetermined distance, and a card that is in contact with the card connector by pressing the case, wherein the predetermined distance is the same as the thickness of the card.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
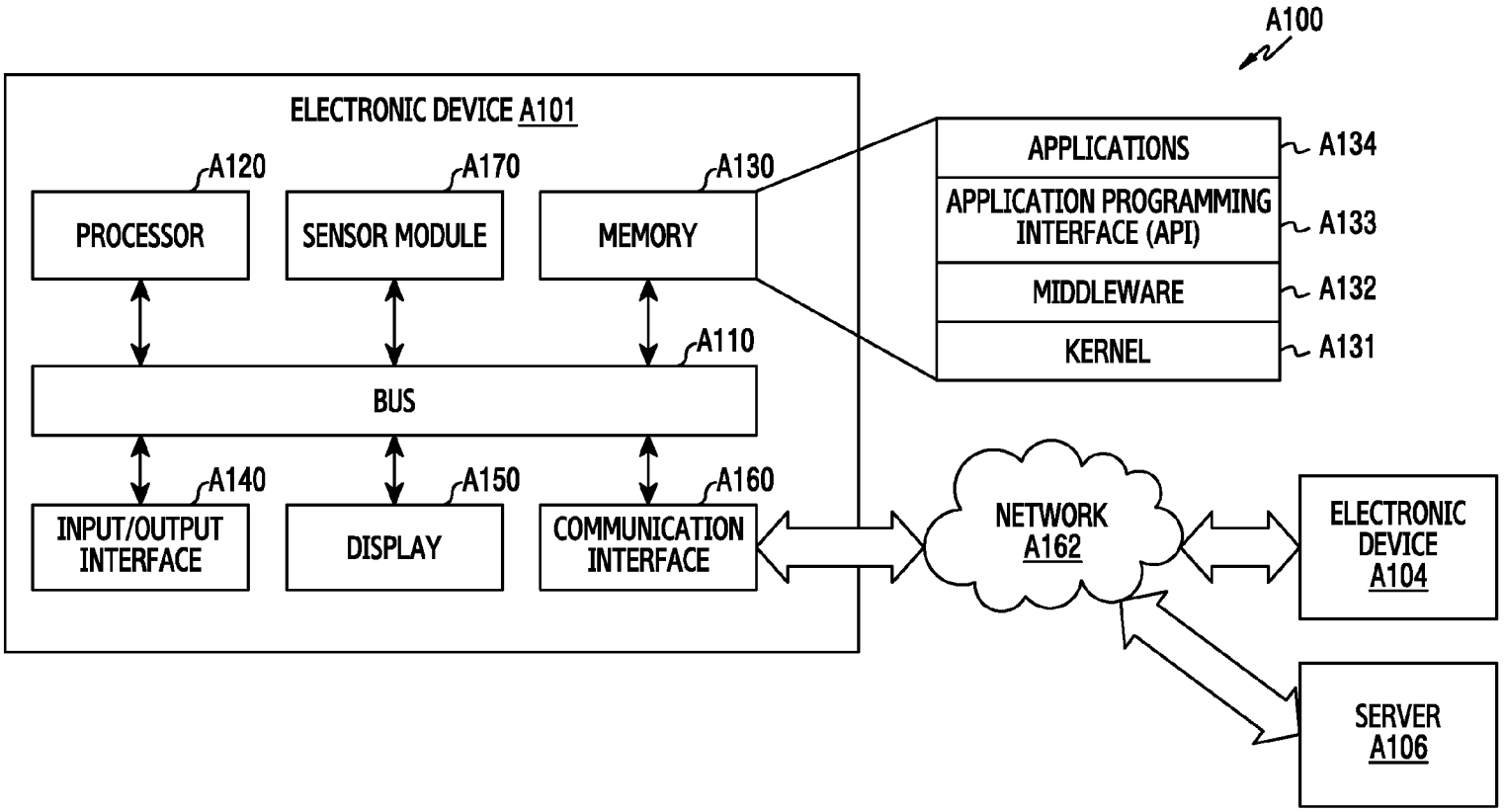
FIG. 1 is a view illustrating an electronic device in a network environment according to various embodiments of the present disclosure.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The term "substantially" used in the various embodiments of present disclosure is used to imply that a cited characteristic, parameter, or value is not necessarily achieved exactly and that an allowable error, a measurement error, a limitation of measurement accuracy, a deviation or change including other elements known to a person skilled in the art, and an effect that a characteristic is to provide are not excluded.

The terms "include" or "may include" used in the various embodiments of the present disclosure indicate the presence of disclosed corresponding functions, operations, elements, and the like, and do not limit additional one or more functions, operations, elements, and the like. In addition, it should be understood that the terms "include" or "have" used in the various embodiments of the present disclosure are to indicate the presence of features, numbers, operations, elements, parts, or a combination thereof described in the specifications, and do not preclude the presence or addition of one or more other features, numbers, operations, elements, parts, or a combination thereof.

The term "or" used in the various embodiments of the present disclosure includes any and all combinations of words enumerated with it. For example, "A or B" means including A, including B, or including both A and B.

Although the terms such as "first" and "second" used in the various embodiments of the present disclosure may modify various elements of the various embodiments, these terms do not limit the corresponding elements. For example, these terms do not limit an order and/or importance of the corresponding elements. These terms may be used for the purpose of distinguishing one element from another element. For example, a first user device and a second user device all indicate user devices and may indicate different user devices. For example, a first element may be named a second element without departing from the scope of right of the various embodiments of the present disclosure, and similarly, a second element may be named a first element.

It will be understood that when an element is mentioned as being "connected" or "coupled" to another element, the element may be directly connected or coupled to another element, and there may be an intervening element between the element and another element. To the contrary, it will be understood that when an element is mentioned as being "directly connected" or "directly coupled" to another element, there is no intervening element between the element and another element.

The terms used in the various embodiments of the present disclosure are for the purpose of describing specific embodiments only and are not intended to limit the present disclosure.

All of the terms used herein including technical or scientific terms have the same meanings as those generally understood by an ordinary skilled person in the related art unless they are defined otherwise. The terms defined in a generally used dictionary should be interpreted as having the same meanings as the contextual meanings of the relevant technology and should not be interpreted as having ideal or exaggerated meanings unless they are clearly defined in the various embodiments of the present disclosure.

An electronic device according to various embodiments of the present disclosure may be a device that is equipped with a communication function. For example, the electronic device may include at least one of a smartphone, a tablet personal computer (PC), a mobile phone, a video phone, an electronic book reader, a desktop PC, a laptop PC, a netbook computer, a personal digital assistant (PDA), a portable multimedia player (PMP), a Moving Picture Experts Group phase 1 or phase 2 (MPEG-1 or MPEG-2) audio layer 3 (MP3) player, a mobile medical machine, a camera, or a wearable device (e.g., a head-mounted device (HMD) such as electronic glasses, electronic clothing, an electronic bracelet, an electronic necklace, an electronic appcessory, electronic tattoos, or a smartwatch).

According to an embodiment of the present disclosure, the electronic device may be a smart home appliance that is equipped with a communication function. For example, the smart home appliance may include at least one of a television (TV), a digital versatile disc (DVD) player, a stereo, a refrigerator, an air conditioner, a cleaner, an oven, a microwave oven, a washing machine, an air cleaner, a set-top box, a TV box (for example, Samsung HomeSync™, Apple TV™, or Google TV™), a game console, an electronic dictionary, an electronic key, a camcorder, or an electronic album.

According to an embodiment of the present disclosure, the electronic device may include at least one of various medical machines (for example, magnetic resonance angiography (MRA), magnetic resonance imaging (MRI), computerized tomography (CT), a tomograph, an ultrasound machine, and the like), a navigation device, a global positioning system (GPS) receiver, an event data recorder (EDR), a flight data recorder (FDR), an automotive infotainment device, electronic equipment for ship (for example, a navigation equipment for ship, a gyro compass, and the like), avionics, a security device, or an industrial or home robot.

According to an embodiment of the present disclosure, the electronic device may include at least one of a part of furniture or a building/a structure including a communication function, an electronic board, an electronic signature receiving device, a projector, and various measurement devices (for example, water, power, gas, radio waves, and the like). The electronic device according to various embodiments of the present disclosure may be one or a combination of one or more of the above-mentioned devices. In addition, it is obvious to an ordinary skilled person in the related art that the electronic device according to various embodiments of the present disclosure is not limited to the above-mentioned devices.

Hereinafter, an electronic device according to various embodiments of the present disclosure will be explained with reference to the accompanying drawings. The term "user" used in the various embodiments of the present disclosure may refer to a person who uses the electronic device or a device that uses the electronic device (for example, an artificial intelligence electronic device).

FIG. 1 illustrates a network environment A100 including an electronic device A101 according to various embodiments of the present disclosure.

Referring to FIG. 1, the electronic device A101 may include a bus A110, a processor A120, a memory A130, an input and output interface A140, a display A150, a communication interface A160, and a sensor module A170.

The bus A110 may be a circuit which connects the above-described elements with one another and transmits communication signals (for example, a control message) between the above-described elements.

The processor A120 may receive instructions from the other elements (for example, the memory A130, the input and output interface A140, the display A150, the communication interface A160, or the sensor module A170) via the bus A110, decipher the instructions, and perform calculation or data processing according to the deciphered instructions.

The memory A130 may store instructions or data which is received from or generated by the processor A120 or the other elements (for example, the input and output interface A140, the display A150, the communication interface A, the sensor module A170, and the like). For example, the memory A130 may include programming modules such as a kernel A131, middleware A132, an application programming interface (API) A133, an application A134, and the like. Each of the above-described programming modules may be configured by software, firmware, hardware, or a combination of two or more of them.

The kernel A131 may control or manage system resources (for example, the bus A110, the processor A120, the memory A130, and the like) which are used for performing operations or functions implemented in the other programming modules, for example, the middleware A132, the API A133, or the application A134. In addition, the kernel A131 may provide an interface for allowing the middleware A132, the API A133, or the application A134 to access an individual element of the electronic device A101 and control or manage the element.

The middleware A132 may serve as an intermediary to allow the API A133 or the application A134 to communicate with the kernel A131 and exchange data with the kernel A131. In addition, the middleware A132 may perform controlling (for example, scheduling or load balancing) with respect to work requests received from the application A134, for example, by giving priority to use the system resources of the electronic device A101 (for example, the bus A110, the processor A120, the memory A130, and the like) to at least one of the applications A134.

The API A133 may be an interface for allowing the application A134 to control a function provided by the kernel A131 or the middleware A134, and, for example, may include at least one interface or function (for example, instructions) for controlling a file, controlling a window, processing an image, or controlling a text.

According to various embodiments of the present disclosure, the application A132 may include a short message service (SMS)/multimedia messaging service (MMS) application, an email application, a calendar application, a notification application, a health care application (for example, an application for measuring exercise or a blood sugar), an environment information application (for example, an application for providing information on atmospheric pressure, humidity, or temperature), and the like. Additionally or alternatively, the application A134 may be an application related to information exchange between the electronic device A101 and an external electronic device (for example, an electronic device A102 or an electronic device A104). For example, the application related to the information exchange may include a notification relay application for relaying specific information to the external electronic device or a device management application for managing the external electronic device.

For example, the notification relay application may include a function of relaying notification information generated by other applications of the electronic device A101 (for example, the SMS/MMS application, the email application, the health care application, the environment information application, and the like) to the external electronic device (for example, the electronic device A102 or the electronic device A104). Additionally or alternatively, the notification relay application may receive notification information from the external electronic device (for example, the electronic device A102 or the electronic device A104) and may provide the same to the user. For example, the device management application may manage (for example, install, delete or update) a function regarding at least part of the external electronic device (e.g.: the electronic device A102 or the electronic device A104) communicating with the electronic device A101 (for example, turning on/off the external electronic device (or some parts) or adjusting brightness of a display), an application operating in the external electronic device or a service provided by the external electronic device (e.g.: a calling service or a message service).

According to various embodiments of the present disclosure, the application A134 may include an application specified according to an attribute (for example, a kind of an electronic device) of the external electronic device (for example, the electronic device A102 or the electronic device A104). For example, when the external electronic device is an MP3 player, the application A134 may include an application related to music replay. Similarly, when the external electronic device is a mobile medical device, the application A134 may include an application related to health care. According to an embodiment of the present disclosure, the application A134 may include at least one of an application specified by the electronic device A101 or an application received from the external electronic device (for example, a server A106, the electronic device A102, or the electronic device A104).

The input and output interface A140 may transmit instructions or data input by a user through a sensor (for example, an acceleration sensor or a gyro sensor) or an input device (for example, a keyboard or a touch screen) to the processor A120, the memory A130, or the communication interface A160 through the bus A110, for example. For example, the input and output interface A140 may provide data on a user's touch input through a touch screen to the processor A120. In addition, the input and output interface A140 may output instructions or data received from the processor A120, the memory A130, the communication interface A160, or the sensor module A170 through the bus A110 through an output device (for example, a speaker or a display). For example, the input and output interface A140 may output voice data processed through the processor A120 to the user through a speaker.

The display A150 may display a variety of information (for example, multimedia data, text data, and the like) for the user.

The communication interface A160 may connect communication between the electronic device A101 and the external device (for example, the electronic device A102, the electronic device A104, or the server A106). For example, the communication interface A160 may support network communication A162 (for example, the Internet, a local area network (LAN), A wired area network (WAN), a telecommunication network, a cellular network, a satellite network, a plain old telephone service (POTS), and the like), and short-distance communication 164 (for example, Wi-Fi, Bluetooth (BT), near field communication (NFC), or wired communication (for example, a universal serial bus (USB), a high definition multimedia interface (HDMI), a recommended standard 232 (RS-232), or POTS)). According to an embodiment of the present disclosure, a protocol for communicating between the electronic device A101 and the external device (for example, a short-distance communication protocol, a network communication protocol, or a wired communication protocol) may be supported in at least one of the API A133 or the middleware A132. The electronic device A102, A104 may be the same device as the electronic device A101 (for example, the same type of device) or a different device (for example, a different type of device).

The sensor module A170 may measure a physical quantity or detect an operation state of the electronic device, and may convert measured or detected information into electric signals. The sensor module A170 may include at least one of a gesture sensor, a gyro sensor, a barometric pressure sensor, a magnetic sensor, an acceleration sensor, a grip sensor, a proximity sensor, a color sensor (for example, red, green, blue (RGB) sensor), a biosensor, a temperature/humidity sensor, an illumination sensor, and an ultraviolet (UV) sensor.

Additionally or alternatively, the sensor module A170 may include an E-nose sensor, an electromyography (EMG) sensor, an electroencephalogram (EEG) sensor (not shown), an electrocardiogram (ECG) sensor (not shown), an infrared ray (IR) sensor, an iris sensor (not shown), a fingerprint sensor, and the like.

Figure 2:
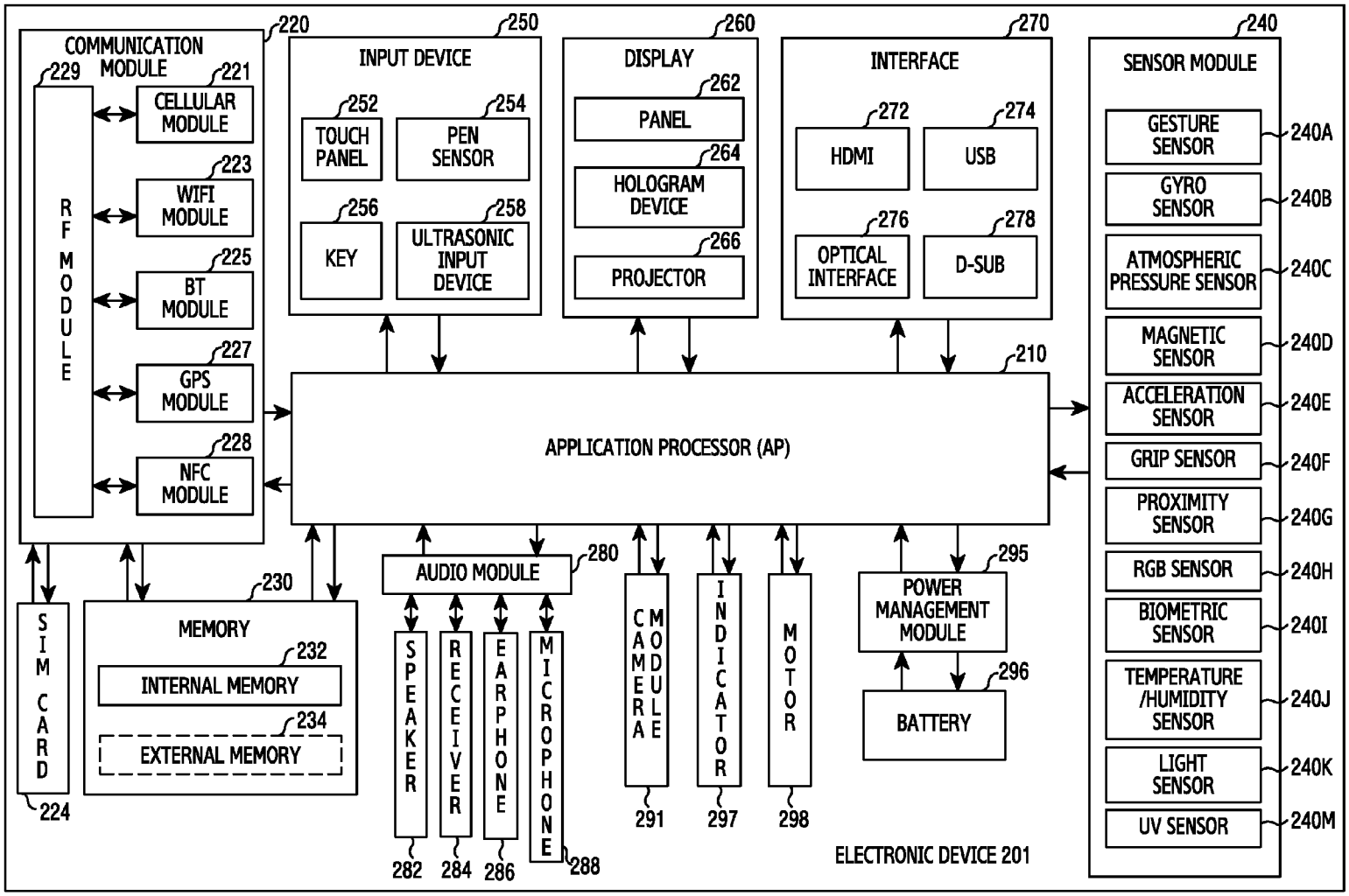
FIG. 2 is a block diagram of an electronic device according to various embodiments of the present disclosure.

FIG. 2 illustrates a block diagram of an electronic device according to various embodiments of the present disclosure. The electronic device 201 may configure the entirety or part of the electronic device A101 shown in FIG. 1.

Referring to FIG. 2, the electronic device 201 may include one or more application processors (APs) 210, a communication module 220, a subscriber identity module (SIM) card 224, a memory 230, a sensor module 240, an input device 250, a display 260, an interface 270, an audio module 280, a camera module 291, a power management module 295, a battery 296, an indicator 297, or a motor 298.

The AP 210 may control a plurality of hardware or software elements connected to the AP 210 by driving an operating system or an application program, and may process and calculate a variety of data including multimedia data. For example, the AP 210 may be implemented by using a system on chip (SoC). According to an embodiment of the present disclosure, the AP 210 may further include a graphics processing unit (GPU) (not shown).

The communication module 220 (for example, the communication interface A160) may transmit and receive data via communication between the electronic device 201 (for example, the electronic device A101) and other electronic devices (for example, the electronic device A104 or the server A106) connected through a network. According to an embodiment of the present disclosure, the communication module 220 may include a cellular module 221, a Wi-Fi module 223, a BT module 225, a GPS module 227, an NFC module 228, and a radio frequency (RF) module 229.

The cellular module 221 may provide a voice call, a video call, a text service, or an internet service through a telecommunications network (for example, long term evolution (LTE), LTE-advanced (LTE-A), code division multiple access (CDMA), wideband CDMA (WCDMA), universal mobile telecommunications system (UMTS), wireless broadband (WiBro), global system for mobile communications (GSM), and the like). In addition, the cellular module 221 may identify and authenticate the electronic device in the telecommunications network by using a SIM (for example, the SIM card 224). According to an embodiment of the present disclosure, the cellular module 221 may perform at least some of the functions provided by the AP 210. For example, the cellular module 221 may perform at least some of the multimedia control functions.

According to an embodiment of the present disclosure, the cellular module 221 may include a communication processor (CP). In addition, the cellular module 221 may be implemented by using an SoC, for example. In FIG. 2, the cellular module 221 (for example, the CP), the memory 230, or the power management module 295 are elements separate from the AP 210. However, according to an embodiment of the present disclosure, the AP 210 may be configured to include at least some of the above-described elements (for example, the cellular module 221).

According to an embodiment of the present disclosure, the AP 210 or the cellular module 221 (for example, the CP) may load instructions or data received from a non-volatile memory connected therewith or at least one of the other elements into a volatile memory, and may process the instructions or data. In addition, the AP 210 or the cellular module 221 may store data which is received from at least one of the other elements or generated by at least one of the other elements in the non-volatile memory.

The Wi-Fi module 223, the BT module 225, the GPS module 227, or the NFC module 228 each may include a processor for processing data received and transmitted through a corresponding module. In FIG. 2, the cellular module 221, the Wi-Fi module 223, the BT module 225, the GPS module 227, or the NFC module 228 is illustrated in a separate block. However, according to an embodiment of the present disclosure, at least some (for example, two or more) of the cellular module 221, the Wi-Fi module 223, the BT module 225, the GPS module 227, or the NFC module 228 may be included in a single integrated chip (IC) or a single IC package. For example, at least some of the processors corresponding to the cellular module 221, the Wi-Fi module 223, the BT module 225, the GPS module 227, and the NFC module 228 (for example, the communication processor corresponding to the cellular module 221 and the Wi-Fi processor corresponding to the Wi-Fi module 223) may be implemented by using a single SoC.

The RF module 229 may transmit and receive data, for example, may transmit and receive an RF signal. Although not shown, the RF module 229 may include a transceiver, a power amp module (PAM), a frequency filter, or a low noise amplifier (LNA), for example. In addition, the RF module 229 may further include a part for exchanging electromagnetic waves in a free space in wireless communication, for example, a conductor or conducting wire. In FIG. 2, the cellular module 221, the Wi-Fi module 223, the BT module 225, the GPS module 227, and the NFC module 228 share the single RF module 229 with one another. However, according to an embodiment of the present disclosure, at least one of the cellular module 221, the Wi-Fi module 223, the BT module 225, the GPS module 227, or the NFC module 228 may transmit and receive an RF signal through a separate RF module.

The SIM card 224 may be a card including a SIM, and may be inserted into a slot formed on a specific location of the electronic device. The SIM card 224 may include unique identification information (for example, an integrated circuit card identifier (ICCID)) or subscriber information (for example, international mobile subscriber identity (IMSI)).

The memory 230 (for example, the memory A130) may include an internal memory 232 or an external memory 234. For example, the internal memory 232 may include at least one of a volatile memory (for example, a dynamic random access memory (DRAM), a static RAM (SRAM), a synchronous DRAM (SDRAM), and the like) and a non-volatile memory (for example, a one-time programmable read only memory (OTPROM), a programmable ROM (PROM), an erasable PROM (EPROM), an electrically erasable PROM (EEPROM), a mask ROM, a flash ROM, a NAND flash memory, a NOR flash memory, and the like).

According to an embodiment of the present disclosure, the internal memory 232 may be a solid state drive (SSD). The external memory 234 may further include a flash drive, for example, compact flash (CF), secure digital (SD), micro-SD, mini-SD, extreme-digital (xD), a memory stick, and the like. The external memory 234 may be functionally connected with the electronic device 201 through various interfaces. According to an embodiment of the present disclosure, the electronic device 201 may further include a storage device (or a storage medium) such as a hard drive.

The sensor module 240 may measure a physical quantity or detect an operation state of the electronic device 201, and may convert measured or detected information into electric signals. The sensor module 240 may include at least one of a gesture sensor 240A, a gyro sensor 240B, a barometric pressure sensor 240C, a magnetic sensor 240D, an acceleration sensor 240E, a grip sensor 240F, a proximity sensor 240G, a color sensor 240H (e.g., RGB sensor), a biosensor 240I, a temperature/humidity sensor 240J, an illumination sensor 240K, and a UV sensor 240M. Additionally or alternatively, the sensor module 240 may include an E-nose sensor (not shown), an EMG sensor (not shown), an EEG sensor (not shown), an ECG sensor (not shown), an IR sensor, an iris sensor (not shown), a fingerprint sensor (not shown), and the like. The sensor module 240 may further include a control circuit to control at least one sensor included therein.

The input device 250 may include a touch panel 252, a (digital) pen sensor 254, a key 256, or an ultrasonic input device 258. The touch panel 252 may recognize a touch input in at least one method of capacitive, resistive, infrared, and ultrasonic methods. In addition, the touch panel 252 may further include a control circuit (not shown). In the embodiment of a capacitive method, the touch panel 252 may recognize physical contact or hovering. The touch panel 252 may further include a tactile layer. In this embodiment of the present disclosure, the touch panel 252 may provide a tactile response to the user.

The (digital) pen sensor 254 may be implemented in the same or similar method as or to the method of receiving a user's touch input or by using a separate detection sheet. The key 256 may include a physical button, an optical key, or a keypad. The ultrasonic input device 258 allows the electronic device 201 to detect sound waves through a microphone (for example, the microphone 288) through an input tool generating ultrasonic signals and identify data, and is capable of wireless recognition. According to an embodiment of the present disclosure, the electronic device 201 may receive a user input from an external device connected thereto (for example, a computer or a server) by using the communication module 220.

The display 260 (for example, the display A150) may include a panel 262, a hologram device 264, or a projector 266. For example, the panel 262 may be a liquid crystal display (LCD) or an active matrix organic light emitting diode (AM-OLED). For example, the panel 262 may be implemented to be flexible, transparent, or wearable. The panel 262 may be configured as a single module along with the touch panel 252. The hologram device 264 may show a stereoscopic image in the air using interference of light. The projector 266 may display an image by projecting light onto a screen. The screen may be located inside or outside the electronic device 201. According to an embodiment of the present disclosure, the display 260 may further include a control circuit to control the panel 262, the hologram device 264, or the projector 266.

The interface 270 may include an HDMI 272, a USB 274, an optical interface 276, or D-subminiature (D-sub) 278. The interface 270 may be included in the communication interface A160 shown in FIG. 1. Additionally or alternatively, the interface 270 may include a mobile high definition link (MHL) interface, an SD/multimedia card (MMC) interface or infrared data association (IrDA) standard interface.

The audio module 280 may convert a sound and an electric signal bidirectionally. At least some element of the audio module 280 may be included in the input and output interface A140 of FIG. 1. The audio module 280 may process sound information which is input or output through a speaker 282, a receiver 284, an earphone 286, or a microphone 288.

The camera module 291 is a device for photographing a still image and a moving image, and, according to an embodiment of the present disclosure, the camera module 291 may include one or more image sensors (for example, a front surface sensor or a rear surface sensor), a lens (not shown), an image signal processor (ISP) (not shown), or a flash (memory) (for example, an LED or a xenon lamp).

The power management module 295 may manage power of the electronic device 201. Although not shown, the power management module 295 may include a power management IC (PMIC), a charger IC, or a battery or fuel gauge.

For example, the PMIC may be mounted in an integrated circuit or an SoC semiconductor. The charging method may be divided into a wire charging method and a wireless charging method. The charger IC may charge a battery and may prevent inflow of overvoltage or over current from a charger. According to an embodiment of the present disclosure, the charger IC may include a charger IC for at least one of the wire charging method and the wireless charging method. The wireless charging method may include a magnetic resonance method, a magnetic induction method, or an electromagnetic wave method, and an additional circuit for charging wirelessly, for example, a circuit such as a coil loop, a resonant circuit, a rectifier, and the like may be added.

For example, the battery gauge may measure a remaining battery life of the battery 296, a voltage, a current, or temperature during charging. The battery 296 may store or generate electricity and may supply power to the electronic device 201 by using stored or generated electricity. The battery 296 may include a rechargeable battery or a solar battery.

The indicator 297 may display a specific state of the electronic device 201 or a part of it (for example, the AP 210), for example, a booting state, a message state, or a charging state. The motor 298 may convert an electric signal into a mechanical vibration. Although not shown, the electronic device 201 may include a processing device (for example, a GPU) for supporting a mobile TV. The processing device for supporting the mobile TV may process media data according to standards such as digital multimedia broadcasting (DMB), digital video broadcasting (DVB), or media flow.

Each of the above-described elements of the electronic device according to various embodiments of the present disclosure may be comprised of one or more components, and the names of the elements may vary according to the kind of the electronic device. The electronic device according to various embodiments of the present disclosure may include at least one of the above-described elements, and some of the elements may be omitted or an additional element may be further included. In addition, some of the elements of the electronic device according to various embodiments of the present disclosure may be combined into a single entity, and may perform the same functions as those of the elements before being combined.

Figure 3:
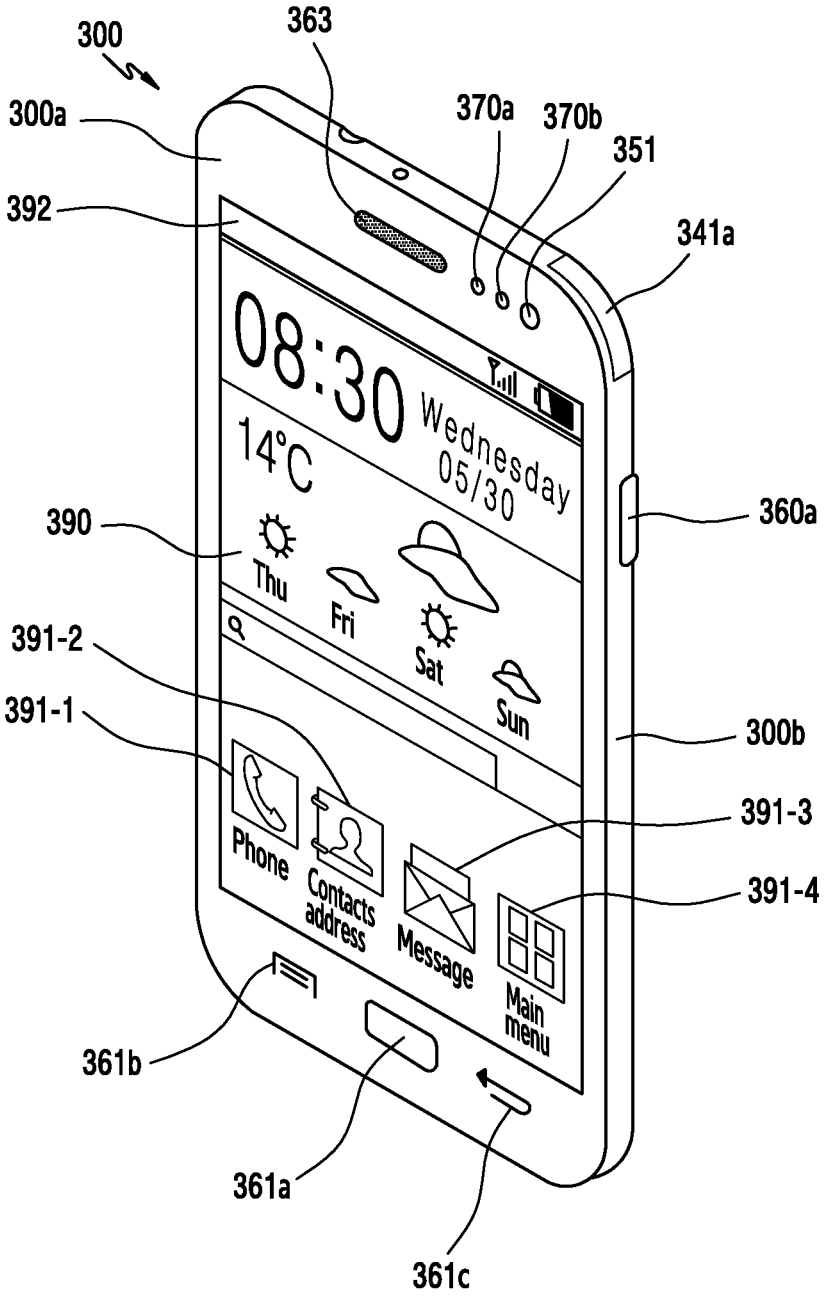
FIG. 3 is a front perspective view of an electronic device according to an embodiment of the present disclosure.
Figure 4:
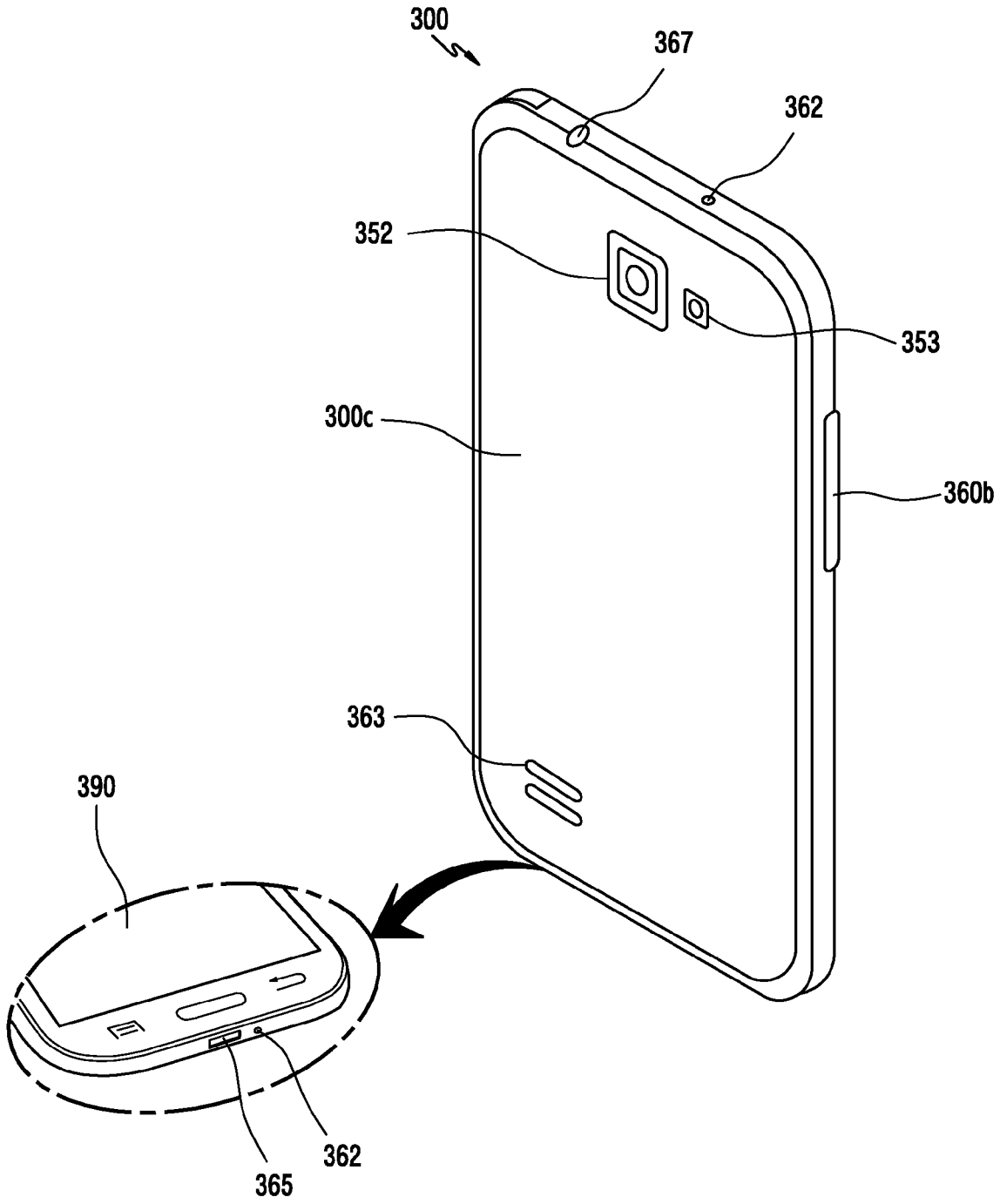
FIG. 4 is a rear perspective view of an electronic device according to an embodiment of the present disclosure.

FIG. 3 is a front perspective view of an electronic device according to an embodiment of the present disclosure. FIG. 4 is a rear perspective view of an electronic device according to an embodiment of the present disclosure.

Referring to FIGS. 3 and 4, a touch screen 390 is arranged at the center of a front surface 300*a* of an electronic device 300. The touch screen 390 is made to be large in order to occupy most of the front surface 300*a* of the electronic device 300. FIG. 2 illustrates an example of displaying a main home screen on the touch screen 390. The main home screen is the first screen that is displayed on the touch screen 390 when a power source of the electronic device 300 is switched on. When the electronic device 300 has different home screens of several pages, the main home screen may be the first home screen of the home screens of several pages. Shortcut icons 391-1, 391-2, and 391-3 for executing frequently used applications, a main menu shift key 391-4, a time, the weather, and the like may be displayed on the home screen. The main menu shift key 391-4 displays a menu screen on the touch screen 390. A status bar 392 for displaying statuses of the device, such as a battery charging status, the intensity of a received signal, and the current time, may be formed at an upper end of the touch screen 390. A home button 361*a*, a menu button 361*b*, and a back button 361*c* may be formed at a lower portion of the touch screen 390.

The home button 361*a* displays the main home screen on the touch screen 390. If the home key 361*a* is touched, for example, while another home screen, which is different from the main home screen or the menu screen, is displayed on the touch screen 390, the main home screen may be displayed on the touch screen 390. If a home button 391*a* is touched while applications are executed on the touch screen 390, the main home screen illustrated in FIG. 2 may be displayed on the touch screen 390. The home button 361*a* may be used to display recently used applications on the touch screen 390, or to display a task manager.

The menu button 361*b* provides connection menus that may be used on the touch screen 390. The connection menus may include a widget added menu, a background screen change menu, a search menu, an edition menu, and an environment setting menu. The back button 361*c* may display a screen that was executed shortly before the currently executed screen, or may complete the most recently used application.

A first camera 351, an illumination intensity sensor 370*a*, and a proximity sensor 370*b* may be arranged at a periphery of the front surface 300*a* of the electronic device 300. A second camera 351, a flash 353, and a speaker 363 may be arranged on a rear surface 300*c* of the electronic device 300.

For example, a power/reset button 360*a*, a volume button 361*b*, a ground wave DMB antenna 341*a* for receiving broadcasts, and one or a plurality of microphones 362 may be arranged on a side surface 300*b* of the electronic device 300. The DMB antenna 341*a* may be fixed to the device 300, or may be detachably mounted on the device 300.

A connector 365 is formed on a side surface of a lower end of the electronic device 300. A plurality of electrodes may be formed in the connector 365 to be connected to an external device in a wired fashion. An earphone connection jack 367 may be arranged on a side surface of an upper end of the electronic device 300. An earphone may be inserted into the earphone connection jack 367. The earphone connection jack 367 may be arranged on a side surface of a lower end of the electronic device 300.

Hereinafter, a card connector will be described with reference to the accompanying drawings.

Figure 5:
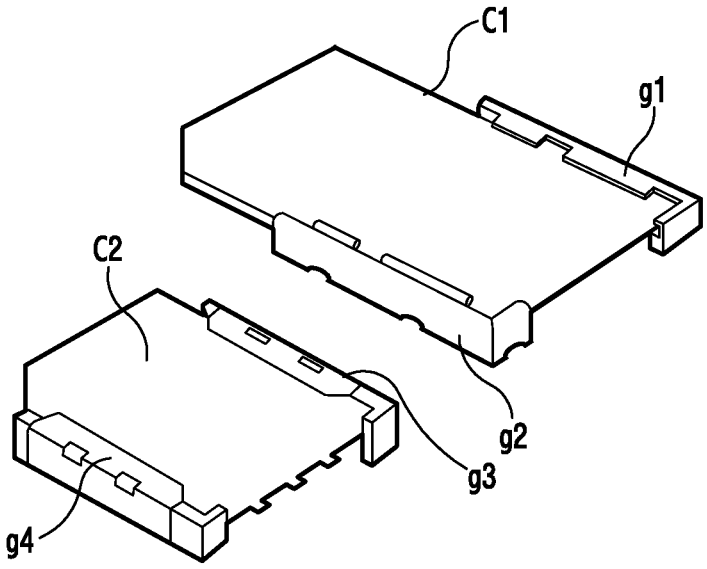
FIG. 5 is a perspective view illustrating a card connector according to an embodiment of the present disclosure.

FIG. 5 illustrates card connectors having different sizes according to an embodiment of the present disclosure.

Referring to FIG. 5, the large-sized card C1 is a SIM card, and the small-sized card C2 is a micro SIM card. The card connectors, according to the embodiment of the present disclosure, may include a board provided with a connection part (not illustrated), and guides g1 and g2 are mounted on the board. The guides g1 and g2 are mounted on the board, and guide the movement of the card C1. The guides g1 and g2 may slide the card C1 in the horizontal direction.

The small-sized card C2 may be connected to the board by the guides g3 and g4. The guides g3 and g4 are mounted on the board, and guide the movement of the card C2. The guides g3 and g4 may slide the card C2 in the horizontal direction.

However, the card connector has a structural problem in that it cannot be implemented in a slim structure. Because the guides are necessary for the safe connection and attachment of the cards, the guides have a structural aspect in that the thickness of the guides cannot be smaller than the thickness of the cards, and because the cards should be connected to the connection part (not illustrated) of the board, it is difficult to make the card connection slim, considering the addition of the thickness of the connection part.

Figure 6:
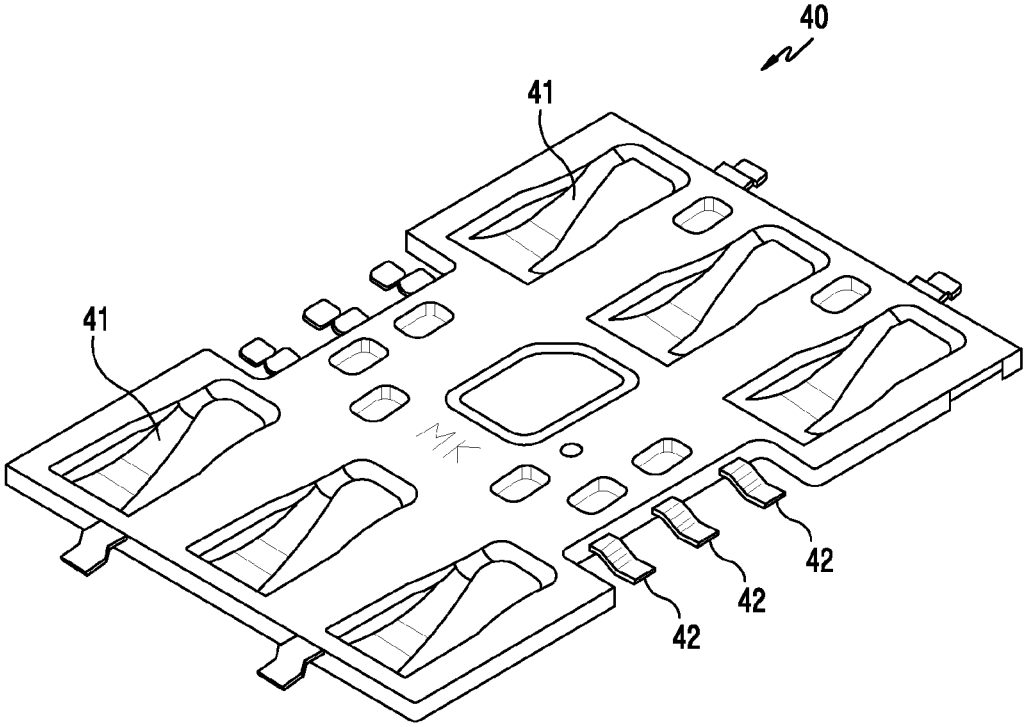
FIG. 6 is a perspective view illustrating a card connector according to an embodiment of the present disclosure.

FIG. 6 is a perspective view illustrating a card connector according to an embodiment of the present disclosure.

Referring to FIG. 6, the card connectors according to the embodiment of the present disclosure may include a board provided with a connection part (not illustrated) and a contact terminal 40 mounted on the board. The contact terminal is mounted on the board and may connect the card to the board. The contact terminal 40 may include a plurality of contact clips 41 connected to the connection part, and a plurality of leads 42 fixed to the board to be connected to the board.

However, the card connector has a structural problem in that it cannot be implemented in a slim structure. The contact terminal is a structure for the connection to the board, and because the contact terminal is mounted on the board, it has a structural aspect in which it is difficult to implement the contact terminal with a thickness smaller than that of the board, and because the contact terminal is slid by the guides (not illustrated), it is difficult to make the card connector slim, considering the addition of the thickness of the guides.

Hereinafter, a configuration of the card connector, according to various embodiments of the present disclosure, will be described with reference to the accompanying drawings.

Figure 7:
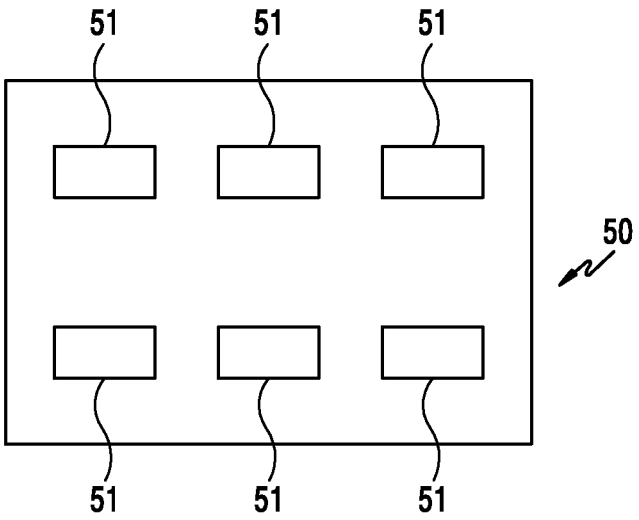
FIG. 7 is a plan view illustrating a board according to various embodiments of the present disclosure.

FIG. 7 is a plan view illustrating a board according to various embodiments of the present disclosure.

Referring to FIG. 7, the board 50, according to various embodiments of the present disclosure, may include a plurality of openings 51 in which the contact terminals, which will be described below, are received to be mounted. The openings 51 may be arranged in the board 50 at an interval, in particular, an equal interval.

The openings 51 may have a hole shape, that is, a vertically opened shape. It is illustrated that six openings 51 are formed in the board 50, and this is because the card has six connection surfaces. However, it is noted that the number of the openings 51 may depend on the type of the card. In addition, the locations of the openings 51 may be changed according to the locations of the connection surfaces of the card.

Figure 8:
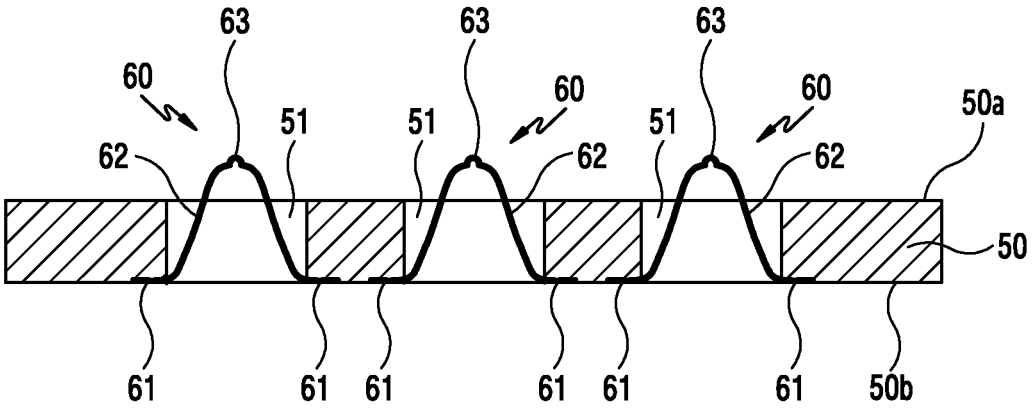
FIG. 8 is a sectional view illustrating a card connector according to various embodiments of the present disclosure.
Figure 9:
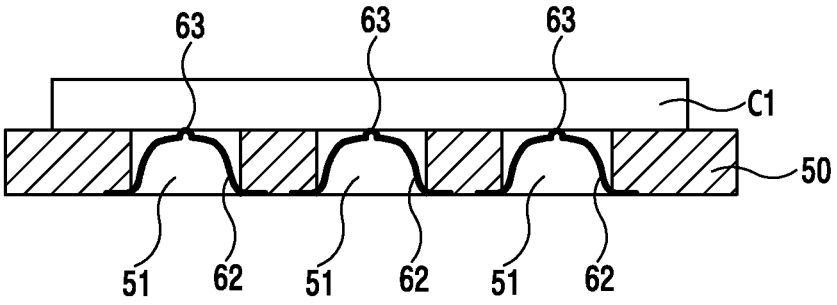
FIG. 9 is a sectional view illustrating a state in which a pressed card is connected to a card connector according to various embodiments of the present disclosure.

FIG. 8 is a sectional view illustrating a card connector according to various embodiments of the present disclosure, and FIG. 9 is a sectional view illustrating a state in which a pressed card is connected to a card connector according to various embodiments of the present disclosure.

Referring to FIGS. 8 and 9, the card connector according to various embodiments of the present disclosure is a connector that pursues slimness, and may be a connector that may contribute to the slimness of the electronic device. In particular, the card connector, according to various embodiments of the present disclosure, has a connection structure, of which the thickness is substantially the same as that of the board 50, and the thickness (protrusion height) of the guides 65 may be substantially the same as that of the card C1. Furthermore, the card connector, according to various embodiments of the present disclosure, may be a connector that is free at an arrangement location thereof. In addition, the connector, according to various embodiments of the present disclosure, may be a connector that may be adopted in a wearable device that has a narrow component mounting space. In addition, the card connector, according to various embodiments of the present disclosure, may include cards that may be mounted on an electronic device. For example, the card may include a SIM card, a micro SIM card, a nano SIM card, an SD card, and a micro SD card.

The card connector, according to various embodiments of the present disclosure, may include a board 50 and a plurality of contact terminals 60. A plurality of openings 51 may be arranged in the board 50 at an equal interval. The contact terminals 60 may be mounted on the board 50 while being received in the openings 51. In particular, the mounting thickness of the contact terminals 60 may be substantially the same as that of the board 50.

Because the openings 51 have the same configuration and the contact terminals 60 arranged in the openings 51 also have the same configuration, a mounting structure of one contact terminal arranged in one opening will be described.

The contact terminal 60 is mounted on the board 50 in a surface-mount technology (SMT) fashion, and in particular, may be mounted to be received in the opening 51 formed in the board. The contact terminal 60 may have various shapes. The contact terminal 60 is mounted to be received in the opening 51, and may be arranged in the opening 51 when it is connected to the card C1.

The contact terminal 60 may include opposite ends 61 and a resiliently deformed part 62 that is resiliently moved between the opposite ends 61. The opposite ends 61 are fixed ends, and the resiliently deformed part may have a shape that is convexed upwards with respect to an upper surface 50*a* of the board 50. The opposite ends of the contact terminal may be fixed to the bottom surface 50*b* of the board, and a part, except for the opposite ends 61, is received in the opening 51 to be moved resiliently.

When the contact terminal 60 is not connected to the card C1, an apex of the resiliently deformed part 62 may be arranged outside the opening. However, when the contact terminal 60 is connected to the card C1, the resiliently deformed part 62 may be arranged to be received in the opening 51. The size of the opening 51 is sufficient as long as the opening 51 may accommodate the movement or deformed state of the resiliently deformed part 62. A state in which the contact terminal 60 is not connected to the card C1 is illustrated in FIG. 8, and a state in which the contact terminal 60 is connected to the card C1 to be pressed is illustrated in FIG. 9.

At least one connection boss 63 may be further provided at an apex of the resiliently deformed part 62 of the contact terminal. One or a plurality of connection bosses 63 may be provided. The connection boss 63 may have a semispherical shape. The connection boss 63 makes the connection state with the connection part (not illustrated) of the card C1 firm.

Accordingly, in the card connector according to various embodiments of the present disclosure, a plurality of contact terminals 60 are arranged to be received in the openings 51 and are resiliently deformed in the openings 51 when the contact terminals 60 are connected to the card C1, and the arrangement of the contact terminals 60 may contribute to the slimness of the card connector. In particular, because the card connector is configured such that the card C1 is attached to the board 50 in the vertical direction, the contact terminals may be arranged.

Figure 10:
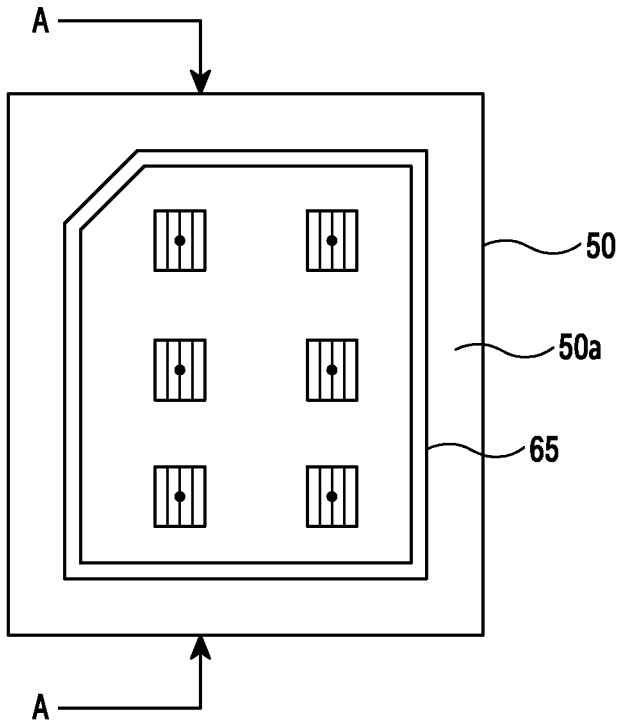
FIG. 10 is a plan view illustrating a state in which a guide is installed in a card connector according to various embodiments of the present disclosure.
Figure 11:
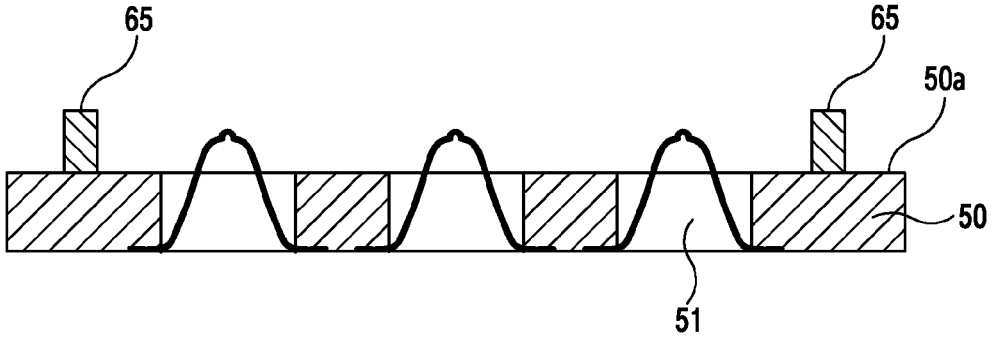
FIG. 11 is a sectional view taken along line A-A of FIG. 10.
Figure 12:
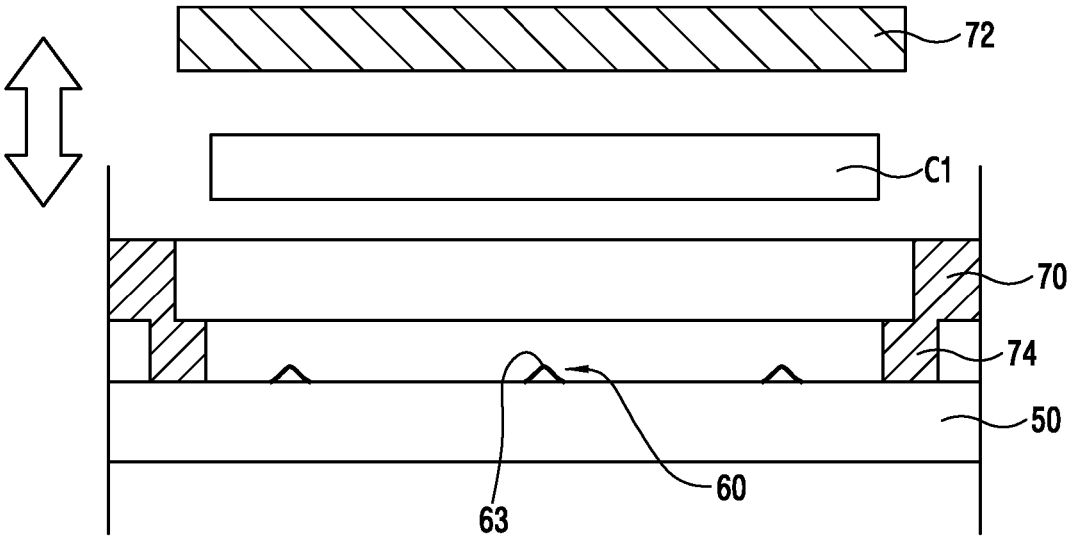
FIG. 12 is a sectional view illustrating a state before a card is connected to an electronic device on which a card connector is mounted according to various embodiments of the present disclosure.

FIG. 10 is a plan view illustrating a state in which a guide is installed in a card connector according to various embodiments of the present disclosure, and FIG. 11 is a sectional view taken along line A-A of FIG. 10.

Referring to FIGS. 10 and 11, the card connector according to various embodiments of the present disclosure may further include a guide 65 that provides a connection state of the card. The guide 65 may be spaced apart from the card to surround the entire circumference of the card or at least a portion of the circumference of the card. The guide 65 may protrude from an upper surface of the board 50 in the form of a vertical wall, in a shape corresponding to a peripheral circumference of the connection part of the board on the upper surface of the board 50; that is, the circumference of the card.

The guide 65 may protrude upwards from the upper surface 50*a* of the board by a predetermined height. The guide 65 may be formed of an injection molding material or a metallic material.

The guide 65 may be formed on the upper surface of the board 50 with a thickness smaller than that of the card. The protrusion thickness of the guide 65 may contribute to the slimness of the card connector when it is smaller than the thickness of the card. Although it is limited in the embodiment of the present disclosure that the guide 65 is independently manufactured and installed in the board 50, the guide 65 may be formed by extending at least a portion of the case of the electronic device. The configuration thereof will be described below.

Figure 13:
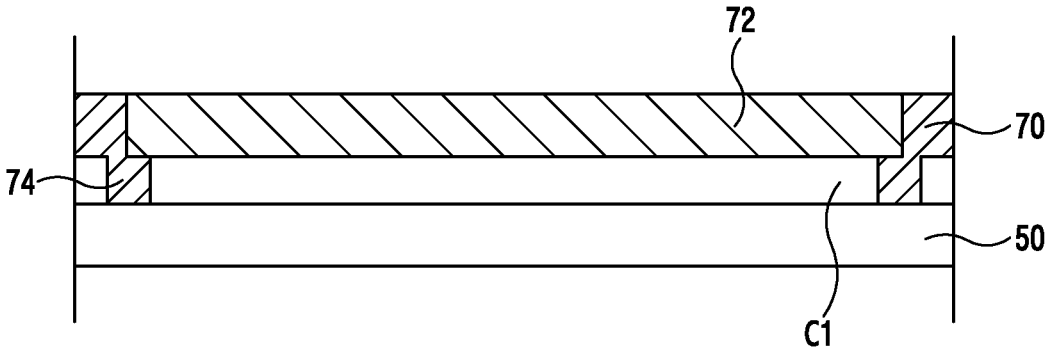
FIG. 13 is a sectional view illustrating a state in which a card is connected to an electronic device on which a card connector is mounted according to various embodiments of the present disclosure.
Figure 14:
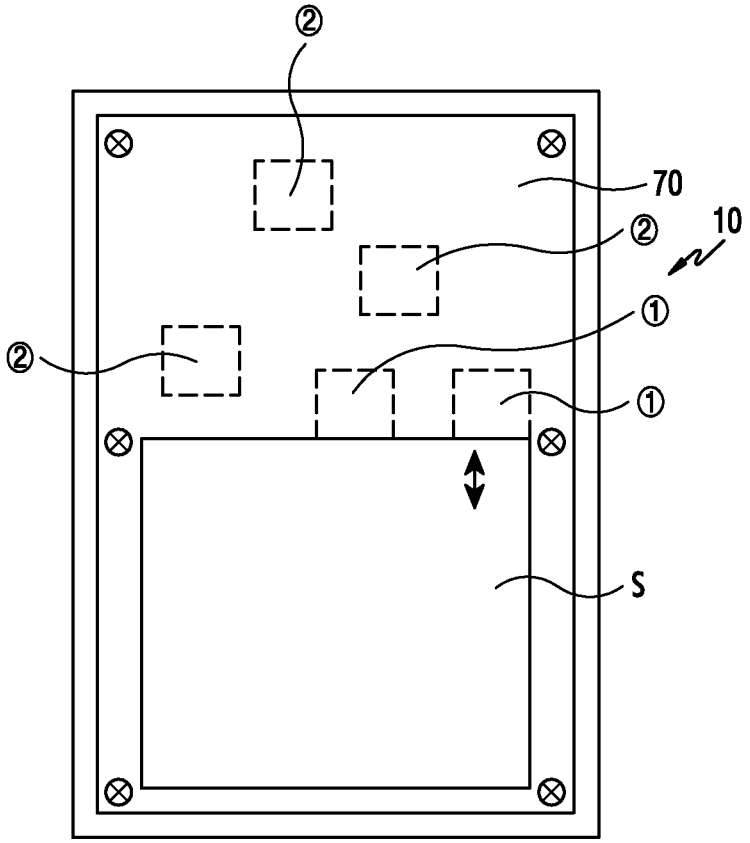
FIG. 14 is a view illustrating an arrangement location of a card connector of an electronic device according to various embodiments of the present disclosure.

FIG. 13 is a sectional view illustrating a state in which a card is connected to an electronic device on which a card connector is mounted according to various embodiments of the present disclosure, and FIG. 14 is a view illustrating an arrangement location of a card connector of an electronic device according to various embodiments of the present disclosure.

Referring to FIGS. 13 and 14, the card C1 may be vertically moved from the board 50 to be connected to or separated from the board 50. The external appearance of the electronic device may be formed by the case, and various electronic components may be supported by the case. For example, the case of the electronic device may include a front case, a rear case, and a battery case that acts as a battery cover. The electronic device includes an inner bracket (not illustrated), and a display module may be supported by one surface of the inner bracket, and the board may be supported by an opposite surface of the inner bracket. The board 50 may be protected by the rear case. The case 70 illustrated in FIGS. 13 and 14 may be a rear case. The rear case 70 may include a cover 72 to attach the card C1 to the board 50. The coupling structure of the rear case 70 and the cover 72 will be omitted. The coupling relationship may be achieved by a known coupling structure of a recess and a boss. The cover 72 functions to press the connected card C1 and to protect the connected card C1, and may be used to separate the connected card C1.

A guide 74 may be integrally formed with the rear case 70. The shape of the guide 74 may be similar to the shapes of FIGS. 10 and 11.

While the card C1 is not connected to the board 50, the apex (connection boss) 63 of the contact terminal 60 may slightly protrude from the upper surface of the board. The card C1 is positioned on the board 50 by the guide 74, and a state of FIG. 13 is formed by coupling the cover 72 to the rear case 70.

In the state of FIG. 13, it can be seen that the card connector, according to various embodiments of the present disclosure, hardly occupies a mounting space. The mounting space may refer to a mounting space and a wiring space that are necessary for mounting components. As described above, because the contact terminals 60 are received in the openings of the board when the card C1 is connected to the contact terminals 60, they hardly occupy the mounting space, and because the height of the guide 74 is smaller than the thickness of the card C1, it hardly occupies a vertical space. Because the card connector, according to various embodiments of the present disclosure, is slim, it may be arranged in various spaces of the electronic device.

Referring to FIG. 14, in general, a rear camera, a flash, a battery slot for accommodating an attached battery, a card connector for attaching a card, and the like may be arranged on the rear surface of an electronic device. The arrangement locations of the listed components may be changed according to the models of the electronic devices. The battery slot is a mounted space for mounting a battery, and a battery terminal (not illustrated) may be provided.

A general card connector has a structure in which a card is slid horizontally to be connected to the board. Because the structure uses a movement space for sliding the card or a structure for sliding the card, it is generally arranged at a location (1) near a slot S. This is because the battery slot S can be shared as the card sliding/movement space when the structure is arranged at the location (1) near the slot S.

However, the arrangement location of the card connector, according to various embodiments of the present disclosure, is not limited to the location (1) near the battery slot, and may also be arranged at various locations (2). Because the card does not require a sliding space, it may be arranged at various locations (2) of the electronic device.

Figure 15:
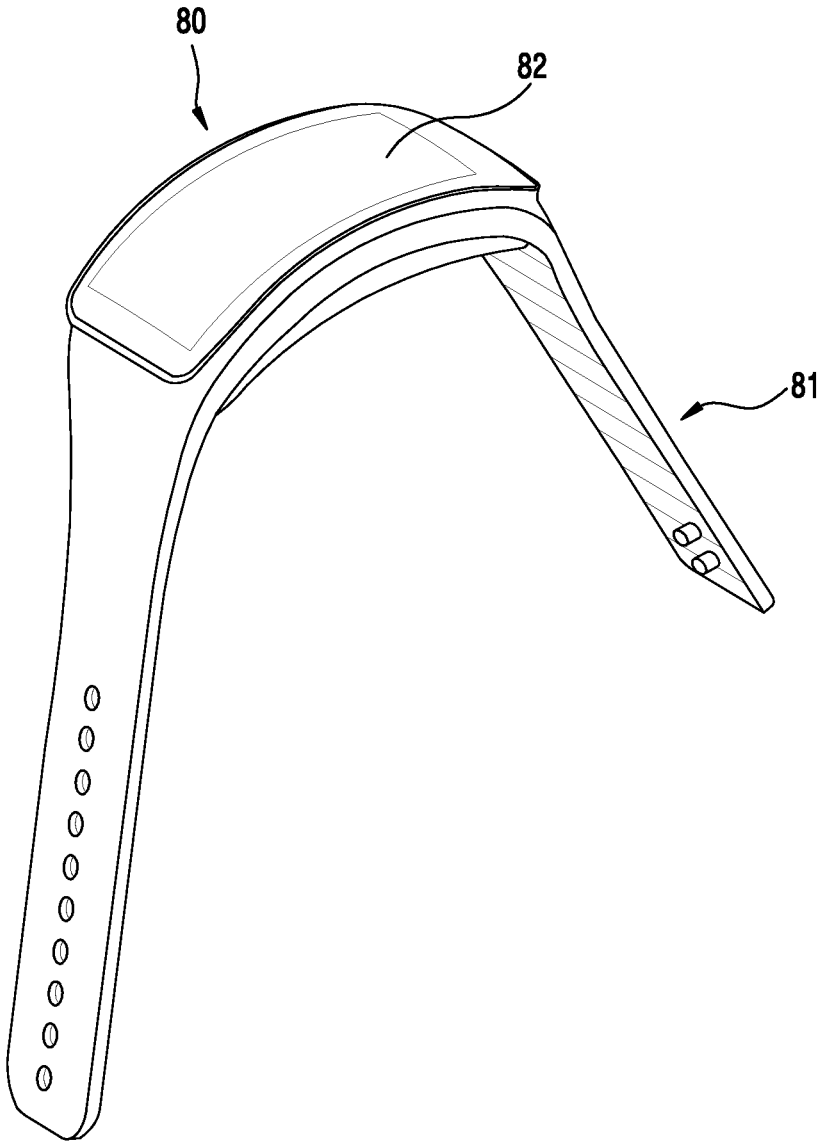
FIG. 15 is a perspective view illustrating a wearable device on which a card connector is mounted according to various embodiments of the present disclosure.
Figure 16:
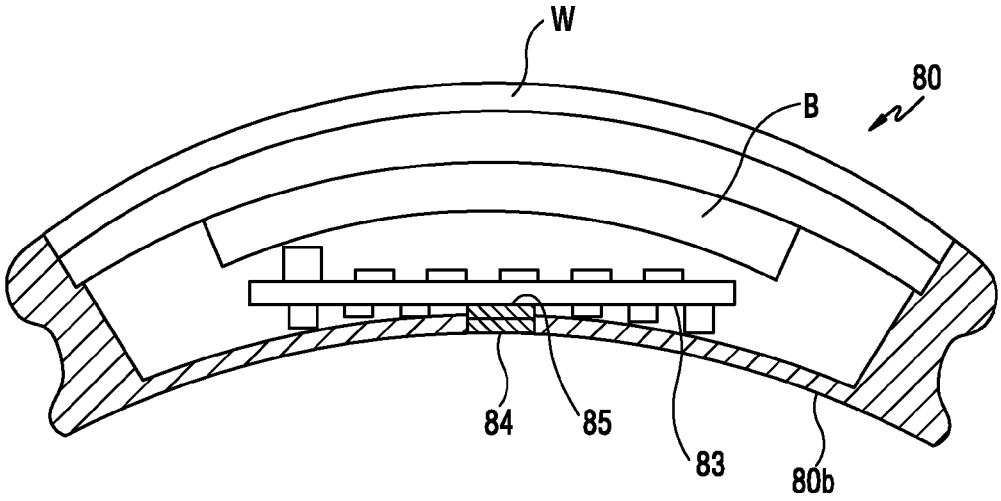
FIG. 16 is a sectional view illustrating the body of a wearable device on which a card connector is mounted according to various embodiments of the present disclosure.

FIG. 15 is a perspective view illustrating a wearable device on which a card connector is mounted according to various embodiments of the present disclosure. FIG. 16 is a sectional view illustrating the body of a wearable device on which a card connector is mounted according to various embodiments of the present disclosure.

Referring to FIGS. 15 and 16, the wearable device, on which a card connector is mounted, according to various embodiments of the present disclosure, is a user device that is mounted on a human body, and for example, an electronic device, a communication device, or an auxiliary medical device that may be conveniently mounted on a wrist similar to a watch or a bracelet. However, the wearable device, according to various embodiments of the present disclosure, may not be limited to being mounted on a wrist. For example, the wearable device, according to various embodiments of the present disclosure, may be applied to a portion of a human body where a curvature is present in the same way. An example of a portion of a human body where a curvature is present may be a wrist, an arm, or an ankle. Furthermore, the wearable device, according to an embodiment of the present disclosure, may be stably mounted on various portions of a human body if the mounting parts are variously configured.

The wearable device, according to various embodiments of the present disclosure, may include a body 80, and a mounting part 81 (including a band or a strap). The body 80 may be necessarily coupled to or separated from the mounting part 81. A display 82 for visually displaying various information, press keys (side keys) k for inputting various information, a sensor, a touch input unit, and the like may be arranged in the body 80. The body 80 has a bar type shape, and has a curvature. In detail, the body 80 extends lengthily in the transverse direction, and has a curvature. The front surface and the rear surface of the body may have curvatures, and may not have a curvature. The mounting part 81 is formed of a resilient material, and accordingly, may stably mount the body 80 to a human body and may attach the body 80 to the skin of the human body. Because the mounting part 81 is exchangeable, it may act as an accessory that displays the personality or tastes of the user.

The wearable device, in particular, mounted on a wrist has a difficulty in mounting various components on a board of the body 80 because the size of the body is the smallest among the portable electronic devices. In particular, there further occurs a difficulty in mounting components if the wearable device is curved to make the mounting feeling of the wrist better. The card connector, according to various embodiments of the present disclosure, may act as a connector of a wearable device mounted on a wrist, and in particular, may be adopted in a wearable having a curved body 80.

Because the structure of the card connection has already been described, a description thereof will be omitted. The cover 84 that presses the card connector (maintains a connection state by pressing the card to the contact terminal) may be a portion of an external rear case 80*b*. If the body 80 is curved and the board 83 is mounted on the body 80, it may be preferable that the card connector be arranged in an area closest to the board 83. Because an intermediate area of the rear surface of the body 80 is substantially closest to the board 83, the card connector may be mounted at a predetermined portion of the board 83. The cover 84 may be attached to and detached from the external rear case 80*b*, and accordingly, a detailed description thereof will be omitted. The attachment structure may include a recess and a boss. The card 85 may continue to be stably connected to the board 80 by the cover 84. The cover 84 may continue to maintain a stable connection state by pressing the card 85 toward the board 80.

Reference symbol W illustrated in FIG. 16 denotes a curved window, and reference symbol B denotes a curved battery pack.

Figure 17:
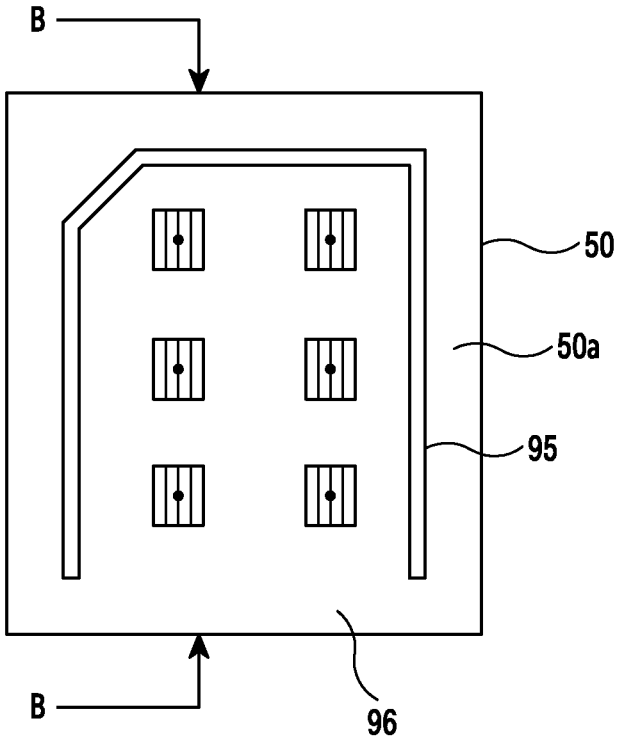
FIG. 17 is a plan view illustrating a state in which a guide is installed in a card connector according to various embodiments of the present disclosure.
Figure 18:
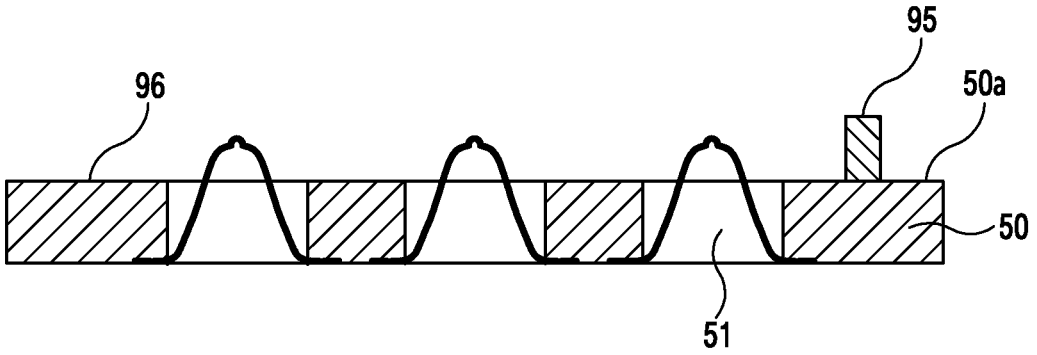
FIG. 18 is a sectional view taken along line B-B of FIG. 10.

FIG. 17 is a plan view illustrating a state in which a guide is installed in a card connector according to various embodiments of the present disclosure, and FIG. 18 is a sectional view taken along line B-B of FIG. 10.

Referring to FIGS. 17 and 18, the card connector, according to various embodiments of the present disclosure, may attach or detach the card in a sliding fashion. If one vertical wall of the guide illustrated in FIGS. 10 and 11 is removed, the card is slid in the horizontal direction to be attached to and detached from the connector. The guide 95, according to various embodiments of the present disclosure, may be formed on the upper surface 50*a* of the board 50 to surround the circumference of the card, and one vertical wall may be removed. Additionally, a separate prevention boss may be formed on the upper surface of the guide. An area 96 from which the vertical wall is removed may be an entrance of the card.

A card connector, according to various embodiments of the present disclosure, includes: a board in which a plurality of openings are arranged at an interval; and a plurality of contact terminals provided in the board to be received in the openings, and the contact terminals are received in the openings, respectively when the contact terminals are connected to a card.

According to various embodiments of the present disclosure, each of the contact terminals is configured such that one end thereof is connected to a bottom surface of the board and an opposite end thereof protrudes towards an upper side of the corresponding opening so that the contact terminal is resiliently moved in the opening.

According to various embodiments of the present disclosure, the card is moved vertically to be attached to or detached from the contact terminals.

According to various embodiments of the present disclosure, a guide for fixing at least a portion of a card positioning location is further formed on an upper surface of the board.

According to various embodiments of the present disclosure, the vertical thickness of the guide is smaller than the thickness of the card.

According to various embodiments of the present disclosure, the guide is formed of an injection molding material or a metallic material, and protrudes from an upper surface of the board in a vertical wall shape.

According to various embodiments of the present disclosure, the card is horizontally slid to be connected to the contact terminals.

According to various embodiments of the present disclosure, the card is any one of a SIM card, a micro SIM card, a nano SIM card, and an SD card.

According to various embodiments of the present disclosure, an electronic device includes: a body case; a board located within the body; a card connector arranged in the board and arranged to be spaced apart from the case by a predetermined distance; and a card that is connected to the card connector by pressing the case, and the predetermined distance is the same as the thickness of the card.

According to various embodiments of the present disclosure, the case includes a rear body case, and an external rear case.

According to various embodiments of the present disclosure, the case includes a cover for vertically attaching the board, and the cover maintains a connection state by pressing the card towards the board.

According to various embodiments of the present disclosure, a guide that fixes a connection location of the card is further formed on an upper surface of the board that faces the case.

According to various embodiments of the present disclosure, a guide that extends towards the board to fix a connection location of the card is further formed in the case.

According to various embodiments of the present disclosure, the guide is integrally injection-molded with the case.

According to various embodiments of the present disclosure, the guide is arranged to surround at least a portion of a circumference of the card in the form of a vertical wall, and the horizontal thickness of the guide is smaller than the thickness of the card.

According to various embodiments of the present disclosure, the electronic device includes a wearable device that is mounted on a wrist, and an external rear case of the wearable device presses a card connector.

According to various embodiments of the present disclosure, the card connector is received in the board.

According to various embodiments of the present disclosure, the card connector is not arranged near a battery slot of the body.

It will be appreciated that embodiments of the present disclosure according to the claims and description in the specification can be realized in the form of hardware, software or a combination of hardware and software.

Any such software may be stored in a non-transitory computer readable storage medium. The non-transitory computer readable storage medium stores one or more programs (software modules), the one or more programs comprising instructions, which when executed by one or more processors in an electronic device, cause the electronic device to perform a method of the present disclosure.

Any such software may be stored in the form of volatile or non-volatile storage such as, for example, a storage device like a ROM, whether erasable or rewritable or not, or in the form of memory such as, for example, RAM, memory chips, device or ICs or on an optically or magnetically readable medium such as, for example, a compact disc (CD), DVD, magnetic disk or magnetic tape or the like. It will be appreciated that the storage devices and storage media are embodiments of non-transitory machine-readable storage that are suitable for storing a program or programs comprising instructions that, when executed, implement various embodiments of the present disclosure.

Accordingly, various embodiments of the present disclosure provide a program comprising code for implementing apparatus or a method as claimed in any one of the claims of this specification and a non-transitory machine-readable storage storing such a program. Still further, such programs may be conveyed electronically via any medium such as a communication signal carried over a wired or wireless connection and the various embodiments of the present disclosure suitably encompass the same.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a case;

a board located within the case;

a card connector arranged in the board and arranged to be spaced apart from the case by a predetermined distance;

a card that is in contact with the card connector by pressing the case, and a guide configured to fix a connection location of the card, the guide formed on an upper surface of the board that faces the case, wherein the predetermined distance is the same as the thickness of the card, wherein the card connector comprises:

a board in which a plurality of openings is arranged at an interval, and a plurality of contact terminals provided in the board to be received in the openings, wherein the contact terminals are received in the openings, respectively, when the contact terminals are in contact with the card, wherein each of the contact terminals is configured such that one end thereof is in contact with a bottom surface of the board and an opposite end thereof protrudes towards an upper side of the corresponding opening so that the contact terminal is resiliently moved in the opening, wherein the card is vertically moved to be in contact with or out of contact with the contact terminals, wherein the guide is arranged to surround at least a portion of a circumference of the card in the form of a vertical wall, and a horizontal thickness of the guide is smaller than a thickness of the card, and wherein the guide is independently manufactured and is mounted on the board in a surface-mount technology (SMT) process.

2. The electronic device of claim 1, wherein the case comprises:

a rear body case, and an external rear case.

3. The electronic device of claim 2, wherein the case further comprises a cover for vertically attaching the board, and wherein the cover maintains a connection state by pressing the card towards the board.

4. The electronic device of claim 1, wherein the guide is integrally injection-molded with the case.

5. The electronic device of claim 1, wherein the electronic device comprises a wearable device mounted on a wrist, and an external rear case of the wearable device presses a card connector.

6. The electronic device of claim 1, wherein the card connector is received in the board.

7. The electronic device of claim 1, wherein the card connector is not arranged near a battery slot of a body.

* * * * *